US011228853B2

(12) United States Patent
Paetsch et al.

(10) Patent No.: US 11,228,853 B2
(45) Date of Patent: Jan. 18, 2022

(54) CORRECT DONNING OF A BEHIND-THE-EAR HEARING ASSISTANCE DEVICE USING AN ACCELEROMETER

(71) Applicant: BOSE CORPORATION, Framingham, MA (US)

(72) Inventors: Christopher R. Paetsch, Cambridge, MA (US); Tegan M. Ayers, Waltham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/855,804

(22) Filed: Apr. 22, 2020

(65) Prior Publication Data

US 2021/0337327 A1 Oct. 28, 2021

(51) Int. Cl.
*H04R 25/00* (2006.01)

(52) U.S. Cl.
CPC ..... *H04R 25/70* (2013.01); *H04R 25/405* (2013.01); *H04R 25/554* (2013.01); *H04R 2225/021* (2013.01)

(58) Field of Classification Search
CPC ..... H04R 25/70; H04R 25/405; H04R 25/554
USPC ..... 381/312
See application file for complete search history.

(56) References Cited

U.S. PATENT DOCUMENTS

| | | | |
|---|---|---|---|
| 8,238,590 | B2 | 8/2012 | Burge |
| 8,243,946 | B2 | 8/2012 | Burge et al. |
| 8,315,406 | B2 | 11/2012 | Kon |
| 8,320,578 | B2 | 11/2012 | Kahn et al. |
| 8,559,621 | B2 | 10/2013 | Gerhardt et al. |
| 8,832,480 | B2 | 9/2014 | Lee et al. |
| 8,949,744 | B2 | 2/2015 | Peissig et al. |
| 8,971,554 | B2 | 3/2015 | van Halteren et al. |
| 9,323,899 | B2 | 4/2016 | Goldstein |
| 9,344,792 | B2 | 5/2016 | Rundle |
| 9,351,090 | B2 | 5/2016 | Tachibana et al. |
| 9,402,124 | B2 | 7/2016 | Zhang |
| 9,439,011 | B2 | 9/2016 | Wardle |
| 9,590,680 | B1 | 3/2017 | Reuss et al. |

(Continued)

FOREIGN PATENT DOCUMENTS

| | | | | |
|---|---|---|---|---|
| CN | 205071294 | U | 3/2016 | |
| EP | 2908550 | A1 * | 8/2015 | ..... H04R 1/406 |
| EP | 2888890 | B1 | 3/2017 | |

*Primary Examiner* — Phylesha Dabney
(74) *Attorney, Agent, or Firm* — Patterson + Sheridan, LLP

(57) ABSTRACT

Aspects of the present disclosure provide methods and apparatuses for determining if a BTE portion of a hearing assistance device is determined to be either a "good fit" (i.e. placed correctly) or "bad fit" (i.e. placed incorrectly). The hearing assistance device includes a sensor in the BTE portion of the device. The sensor measures acceleration due to gravity in one or more of the x, y, and z directions, or any combination thereof. The measured acceleration is input into a pre-trained classifier model that outputs whether the BTE portion is placed correctly or not placed correctly. At least one of the hearing assistance device or a user device in communication with the hearing assistance device provides feedback regarding the positioning of the hearing assistance device. In aspects, the hearing assistance device or the user device guides the user to properly adjust placement of the BTE portion of the device.

17 Claims, 4 Drawing Sheets

(56) References Cited

U.S. PATENT DOCUMENTS

| | | | | |
|---|---|---|---|---|
| 9,596,551 | B2 * | 3/2017 | Pedersen | H04R 25/407 |
| 10,117,012 | B2 | 10/2018 | Saulsbury et al. | |
| 10,206,048 | B2 * | 2/2019 | Petersen | H04R 25/407 |
| 10,771,905 | B2 * | 9/2020 | Petersen | H04R 25/407 |
| 2015/0036835 | A1 * | 2/2015 | Chen | H04R 1/1041 381/74 |
| 2015/0230022 | A1 | 8/2015 | Sakai et al. | |
| 2015/0260754 | A1 | 9/2015 | Perotti et al. | |
| 2016/0357510 | A1 | 12/2016 | Watson et al. | |

* cited by examiner

CORRECT DONNING OF A BEHIND-THE-EAR HEARING ASSISTANCE DEVICE USING AN ACCELEROMETER

FIELD

Aspects of the present disclosure relate to providing feedback to a user regarding the positioning of a behind-the-ear (BTE) hearing assistance device around the user's ear. As described herein, the BTE portion of the hearing assistance device includes at least one sensor for measuring acceleration due to gravity. Based on the measured acceleration due to gravity, one or more of the hearing assistance device or a user device in communication with the hearing assistance device provides feedback to the user regarding how the hearing assistance device is positioned around the user's ear. This feedback helps the user properly don the hearing assistance device.

BACKGROUND

A direct-to-consumer market for hearing assistance devices reduces and essentially eliminates a user visiting an audiologist. As such, the user may not receive one-on-one training regarding how the device works and how to properly don the device. A hearing assistance device should be properly donned in order for the user to realize the benefits of the device. Most hearing assistance devices include one or more microphones. When the hearing assistance device is not properly positioned on the user, the microphone or microphone array may detect the user's voice and negatively impact the signal-to-noise ratio of the signal to be amplified. Further, properly donning a hearing assistance device provides long-term comfort to the user and stability of the device. Thus, methods to help a user properly position a hearing assistance device is desired.

SUMMARY

All examples and features mentioned herein can be combined in any technically possible manner.

Aspects generally describe using a sensor positioned on the BTE portion of a hearing assistance device to measure the acceleration due to gravity when the hearing assistance device is on the ear of a user. Based on the measured acceleration due to gravity, the hearing assistance device, or a user device coupled to the hearing assistance device, provides the user feedback regarding how the hearing assistance device is positioned. In aspects, the user receives guidance or coaching to help the user adjust the positioning of the hearing assistance device around the user's ear to more properly don the device.

According to aspects, a method is performed by a behind-the-ear (BTE) hearing assistance device. The method comprises measuring acceleration due to gravity using an accelerometer positioned on a BTE portion of the hearing assistance device and taking one or more actions to provide feedback to a user regarding how the hearing assistance device is positioned around an ear of the user based, at least in part, on the measured acceleration.

In aspects, the feedback comprises an audio output indication, provided by an audio output transducer of the hearing assistance device, of how the hearing assistance device is positioned. In aspects, the audio output transducer outputs a first audio indication when the hearing assistance device is properly positioned around the user's ear and outputs a second audio indication when the hearing assistance device is not properly positioned around the user's ear.

In aspects, taking the one or more actions comprises transmitting information associated with the measured acceleration to a user device in wireless communication with the hearing assistance device, receiving, from the user device, information regarding how the hearing assistance device is positioned around the ear of the user, and outputting, by an audio output transducer of the hearing assistance device, an audio indication of how the hearing assistance device is positioned based on the received information.

In aspects, taking the one or more actions comprises transmitting information associated with the measured acceleration to a user device in wireless communication with the hearing assistance device to assist in providing the feedback.

In aspects, measuring the acceleration comprises measuring the acceleration using the accelerometer as the position of the hearing assistance device is adjusted around the user's ear. In aspects, taking the one or more actions comprises iteratively providing the feedback calculated based on the measured acceleration as the hearing assistance device is adjusted around the user's ear.

In aspects, the measuring comprises measuring acceleration due to gravity in one of an x, y, z direction, or any combination thereof. In aspects, the measured acceleration due to gravity is input into a pre-trained classifier that outputs that the hearing assistance device is one: of properly positioned about the user's ear or not properly positioned about the user's ear.

Aspects provide a behind-the-ear (BTE) hearing assistance device comprising at least one processor and a memory coupled to the at least one processor, the memory including instructions executable by the at least one processor to cause the hearing assistance device to measure acceleration due to gravity using an accelerometer positioned on a BTE portion of the hearing assistance device and take one or more actions to provide feedback to a user regarding how the hearing assistance device is positioned around an ear of the user based, at least in part, on the measured acceleration.

In aspects, the instructions cause the hearing assistance device to provide the feedback by instructing an audio output transducer of the hearing assistance device to output an indication of how the hearing assistance device is positioned. In aspects, the instructions cause the device to take the one or more actions by instructing the audio output transducer to output a first audio indication when the hearing assistance device is properly positioned around the user's ear and output a second audio indication when the hearing assistance device is not properly positioned around the user's ear.

In aspects, the instructions cause the hearing assistance device to take the one or more actions by transmitting information associated with the measured acceleration to a user device in wireless communication with the hearing assistance device, receiving, from the user device, information regarding how the hearing assistance device is positioned around the ear of the user, and outputting, by an audio output transducer of the hearing assistance device, an audio indication of how the hearing assistance device is positioned based on the received information.

In aspects, the instructions cause the hearing assistance device to take the one or more actions by transmitting information associated with the measured acceleration to a user device in wireless communication with the hearing assistance device to assist in providing the feedback.

In aspects, the instructions cause the hearing assistance device to measure by measuring the acceleration using the accelerometer as the position of the hearing assistance device is adjusted around the user's ear and the instructions cause the hearing assistance device to take the one or more actions by iteratively providing the feedback calculated based on the measured acceleration as the hearing assistance device is adjusted around the user's ear.

In aspects, the instructions cause the hearing assistance device to measure the acceleration by measuring the acceleration due to gravity in one of an x, y, z direction, or any combination thereof.

In aspects, the instructions further cause the hearing assistance device to input the measured acceleration due to gravity into a pre-trained classifier that outputs that the hearing assistance device is one: of properly positioned about the user's ear or not properly positioned about the user's ear.

Certain aspects provide an audio system which includes a BTE hearing assistance device in communication with an application running on a wireless user device. The hearing assistance device comprises a BTE portion coupled to an audio output transducer, and an accelerometer. The BTE portion also comprises at least one microphone, a processor, a memory, and a wireless communication unit, each in the BTE portion of the hearing assistance device, the memory including instructions executable by the processor to cause the hearing assistance device to: measure acceleration due to gravity using the accelerometer when the hearing assistance device is positioned around an ear of a user and transmit the measured acceleration to the application. The application provides feedback to the user regarding how the hearing assistance device is positioned around the user's ear based, at least in part, on the measured acceleration.

In aspects, the feedback provided by the application coaches the user on how to adjust the positioning of the hearing assistance device.

In aspects, the instructions further cause the hearing assistance device to: measure the acceleration using the accelerometer as the position of the hearing assistance device is adjusted around the user's ear and transmit, to the application, the measured acceleration as the position of the hearing assistance device is adjusted around the user's ear. In aspects, the application provides the feedback by iteratively providing the feedback calculated based on the measured acceleration as the hearing assistance device is adjusted around the user's ear.

In aspects, the instructions cause the hearing assistance device to measure the acceleration due to gravity by measuring the acceleration in one of an x, y, z direction, or any combination thereof. The application inputs the measured acceleration due to gravity into a pre-trained classifier that outputs, via the application, that the hearing assistance device is one: of properly positioned about the user's ear or not properly positioned about the user's ear. Some advantages of the methods described herein include not interacting with an audiologist or other person to learn how to don the device and receiving real time feedback regarding the positioning of the BTE portion of the device in addition to benefitting the user's long-term comfort and stability of the device.

DETAILED DESCRIPTION

Figure 1:
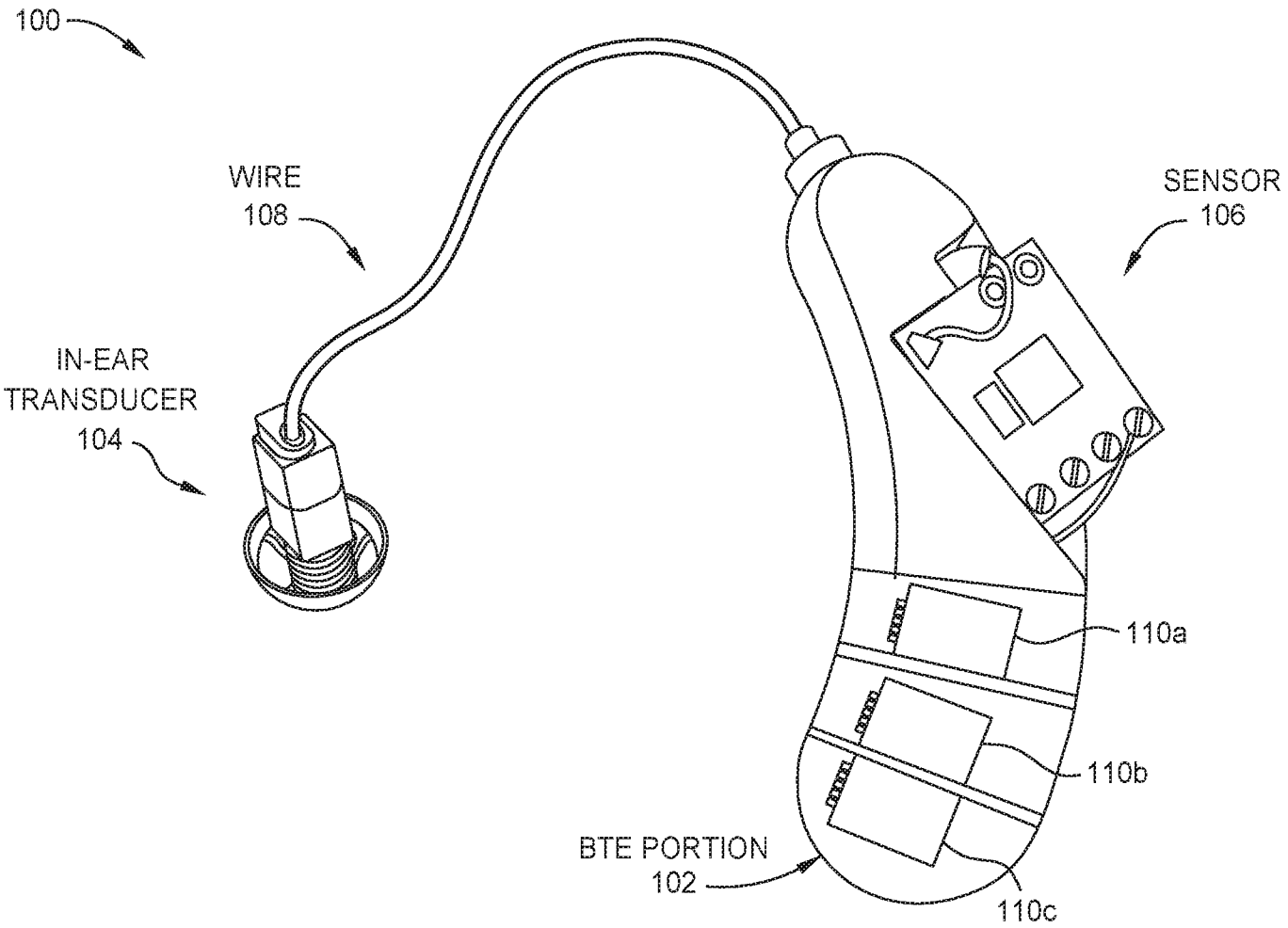
FIG. 1 illustrates an example hearing assistance device.

FIG. 1 illustrates an example hearing assistance device or hearing aid 100. The hearing assistance device 100 includes a BTE portion 102 that fits around the user's ear. The BTE portion 102 is coupled to an in-ear audio output transducer 104. In aspects, the transducer 104 is referred to as a receiver. In FIG. 1, the BTE portion 102 is coupled to the transducer 104 via a wire 108; however, the BTE portion may be wirelessly coupled to the transducer.

The BTE portion 102 includes at least one sensor 106 that measures the acceleration due to gravity. The sensor 106 can be an accelerometer, an inertial measurement unit (IMU) sensor, or any other sensor that can measure acceleration due to gravity. Acceleration due to gravity refers to the acceleration of the hearing assistance device 100 due to the influence of the pull of gravity. As described herein, the acceleration due to gravity of the hearing assistance device 100 is measured by the sensor 106 when the device is placed on the user. As an example, during the process of donning the device 100, the BTE portion 102 is placed behind a user's ear. The device 100 may or may not be properly positioned. Measurements from the sensor 106 are used to provide feedback to the user regarding the positioning of the device 100. In aspects, feedback as the user adjusts the position of the device, guides the user to make adjustments and properly place the BTE portion 102 of the device 100.

The BTE portion also includes at least one external microphone. In FIG. 1, the device 100 includes an array of microphones including microphones 110*a*-110*c*. The position and number of microphones are not limited to the example device 100 illustrated in FIG. 1. While not illustrated, the BTE portion 102 of the device 100 also includes a battery, amplifier, processor, and memory. The components in the BTE portion are all coupled together, directly or indirectly. In aspects, the BTE portion 102 also includes a wireless communication unit for wirelessly communicating with external user devices (e.g., cell phones, personal wearable devices).

The microphones pick up sounds that are to be amplified by the device 100. When the device 100 is properly positioned around a user's ear, the microphones 100*a*-100*c* will pick up sounds to be amplified. The transducer 104 outputs enhanced audio to the user of the device 100.

The memory and processor control the operations of the device 100. The memory stores program code for controlling the memory and processor. The memory may include Read Only Memory (ROM), a Random Access Memory (RAM), and/or a flash ROM. The processor controls the general operation of the device 100. The processor performs process and control for audio and/or data communication. In addition to the general operation, the processor is configured to take one or more actions to provide feedback to a user regarding how the device 100 is positioned around an ear of the user based, at least in part, on the measured acceleration due to gravity. In aspects, the device 100 provides audio feedback regarding the position of the device around the user's ear. In aspects, the information collected via the sensor 106 is transmitted to an external user device, and the user device provides feedback regarding how the device 100 is positioned. The user device provides the feedback via an application ("app") running on the user device. In yet other aspects, both the device 100 and the user device provide feedback. In aspects, any one of the device 100, cloud, and/or user device calculates the acceleration due to gravity based on signals collected by the sensor 106.

Figure 2C:
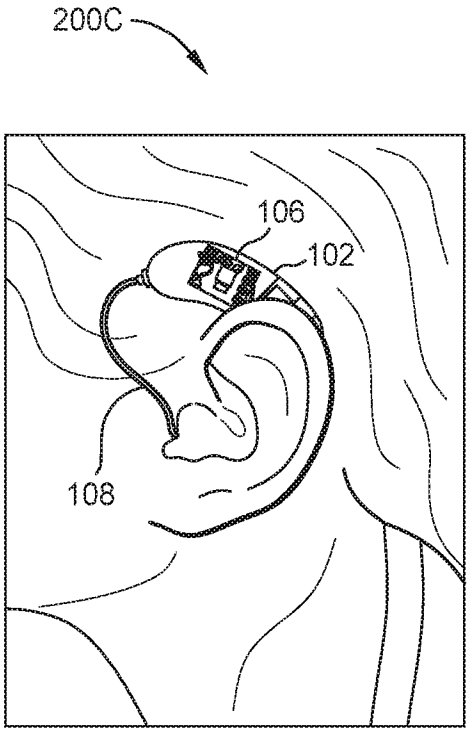
FIGS. 2A-2C illustrate examples of various BTE placements.
Figure 2B:
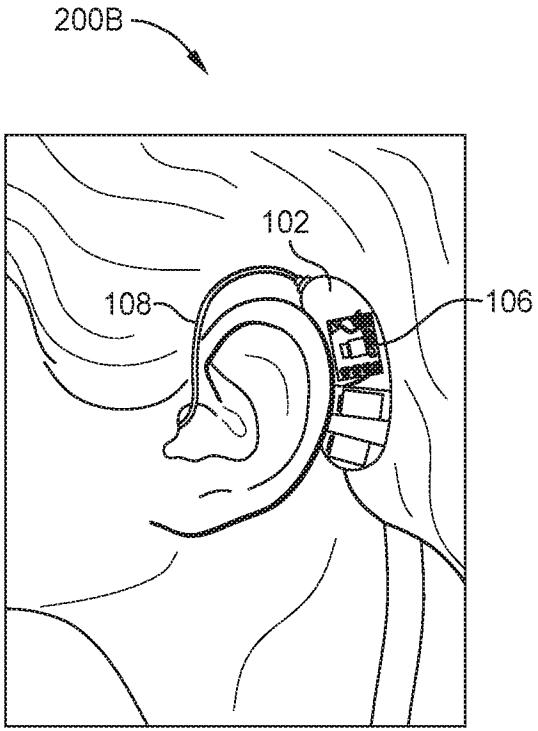
Figure 2A:
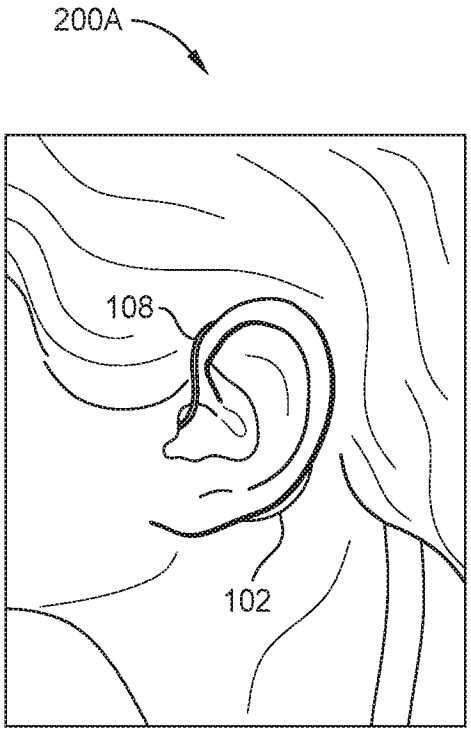

FIGS. 2A-2C illustrate examples 200A-200C of various BTE placements. FIG. 2A illustrates a good fit or good position, meaning the BTE portion 102 is placed correctly around the user's ear. More specifically, and as shown in 200A, a good fit or good position is marked by the wire 108 from the transducer (not visible in FIG. 2A because the transducer is in the user's ear) to the BTE portion 102 being extended and the BTE portion 102 being positioned directly behind the user's ear.

FIG. 2B and FIG. 3B illustrate a bad fit or bad position, meaning the BTE portion 102 is placed incorrectly. As described above, poor or incorrect placement of the BTE portion 102 has an adverse effect on the assistance provided to the user by the device 100. Poor or incorrect placement also have adverse effects on the user's comfort wearing the device and the stability of the device. As shown in 200B, the BTE portion 102 is hanging off of the user's ear. As shown in 200C, the BTE portion 102 is above the user's ear. In both 200B and 200C, the wire 108 is not fully extended, for example, as compared to when the BTE is properly placed as shown in 200A.

Figure 3:
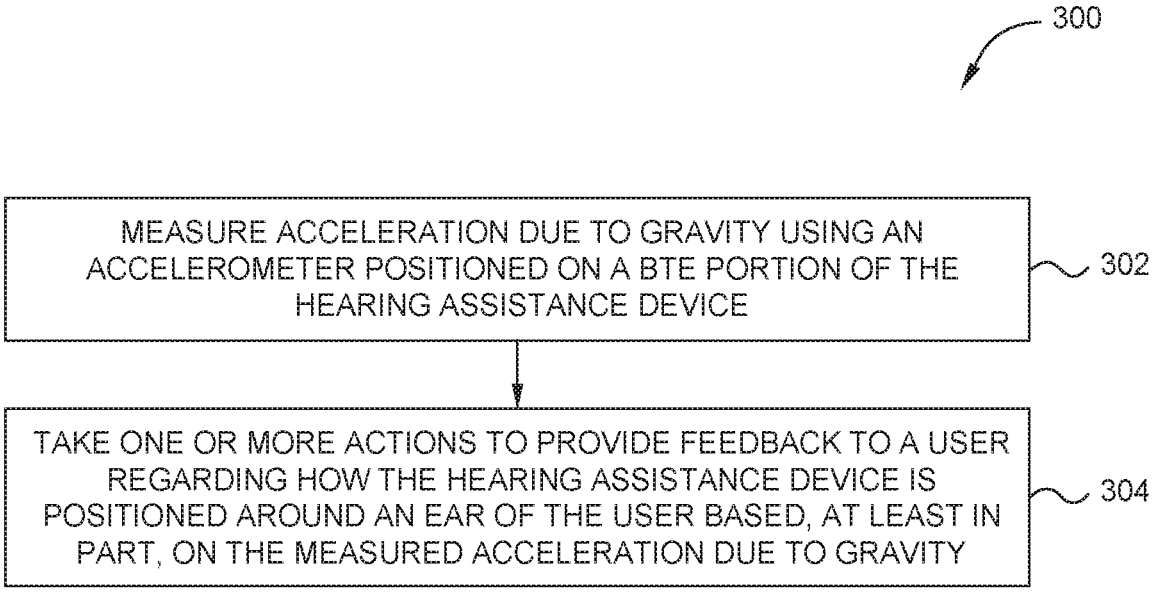
FIG. 3 illustrates example operations performed by a BTE hearing assistance device in accordance with aspects of the present disclosure.

FIG. 3 illustrates example operations 300 for providing feedback to a user regarding the positioning of the BTE portion of a hearing assistance device, in accordance with aspects of the present disclosure. The operations may be performed by a hearing assistance device such as device 100.

At 302, at least one sensor on the BTE portion of the hearing assistance device measures acceleration due to gravity using an accelerometer positioned on a BTE portion of the hearing assistance device. In aspects, the sensor is an accelerometer or IMU.

At 304, the hearing assistance device takes one or more actions to provide feedback to a user regarding how the hearing assistance device is positioned around an ear of the user based, at least in part, on the measured acceleration due to gravity.

In order to provide real-time feedback to a user regarding the positioning of the BTE portion based on measured acceleration due to gravity, data was collected using volunteers donning a BTE and a classifier model was built. First, an accelerometer was placed in a fixed and unchanging position within the BTE portion of a hearing assistance device. Second, several subjects donned the BTE portion of the device in multiple positions, making note of whether the BTE portion was a good fit and properly positioned or a bad fit and improperly positioned. The accelerometer collected a short measurement of acceleration in the x, y, and z directions. Since the accelerometer was not moving, the accelerometer measured static acceleration, or acceleration due to gravity. The collected measurements were used to determine the tilt of the accelerometer in the BTE. A labeled training set was determined with the data collected from this process performed on several volunteer subjects. With a sufficient amount of collected data, a classifier model was built.

A classifier model can be built using the training set using one of several methods. In one example, a supervised machine learning classifier, such as a Support Vector Machine (SVM), is built. Training an SVM consists of finding the optimal hyperplane or the place that produces maximal margin (maximum distance between data points). With an SVM, the raw acceleration measured in the x, y, and/or z directions are input into the model and a good/proper or bad/improper fit is output. In another example, the tilt angle of the accelerometer relative to the direction of gravity is calculated using Equation (1), where $A_X$ represents acceleration due to gravity in the x direction, $A_Y$ represents acceleration due to gravity in they direction, and $A_Z$ represents acceleration due to gravity in the z direction.

$$\text{Tilt} = \frac{A_Y}{A_X^2 + A_Y^2 + A_Z^2} \qquad \text{Equation (1)}$$

Figure 4:
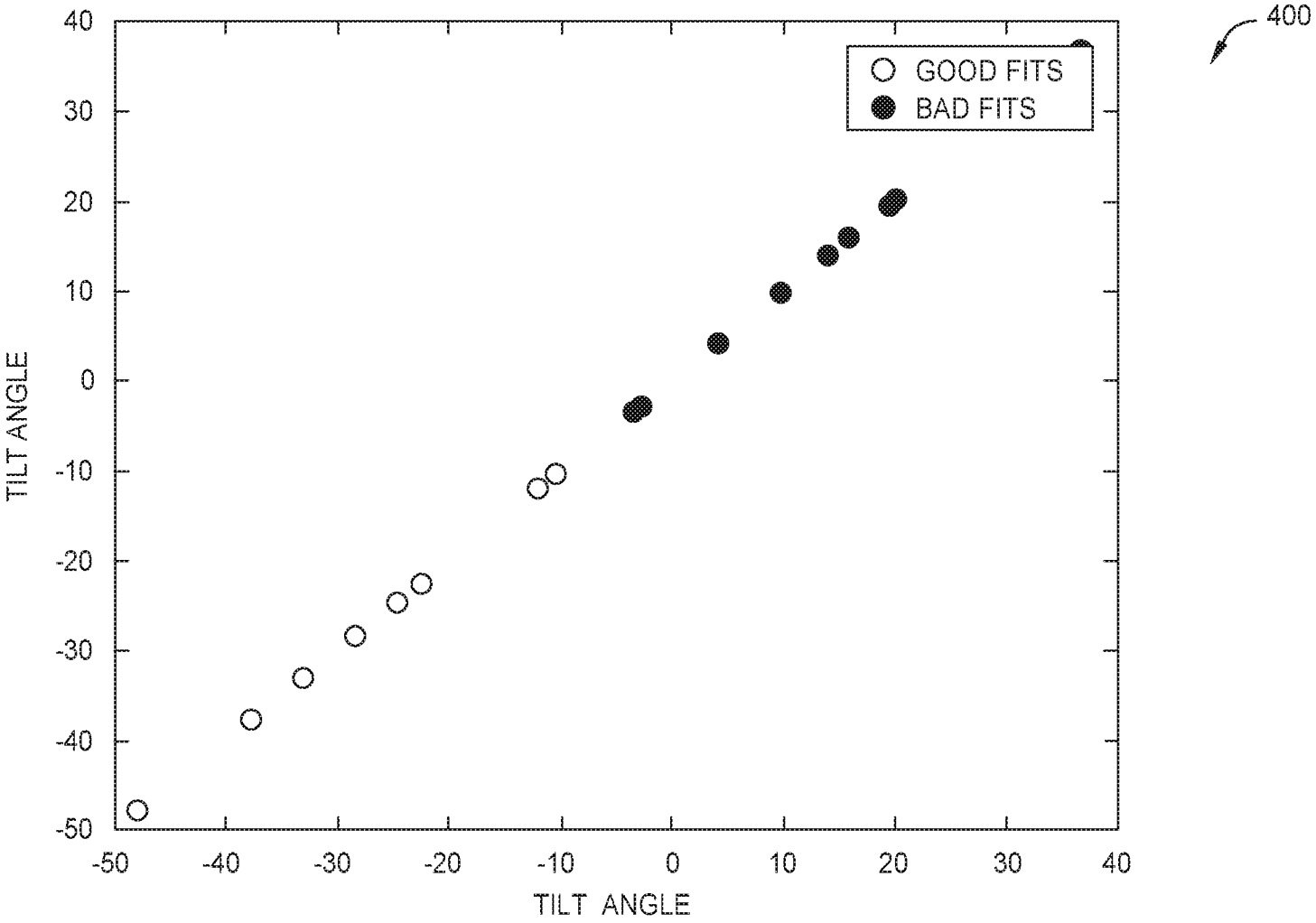
FIG. 4 illustrates an example tilt angle of the accelerometer relative to the direction of gravity plotted as a function of BTE positioning.

Using the calculated tilt angle, the threshold tilt angle for a good/proper fit and poor/improper fit is determined. The threshold tilt angle can be determined through plotting or through linear regression. FIG. 4 illustrates an example 400 plot of tilt angles plotted as a function of good/proper fit or poor/improper fit. In the example plot 400, the threshold angle for a poor/improper fit is approximately −5°. Once built, the classifier is deployed onto a device, such as the hearing assistance device 100.

In an example use case, and with reference to FIG. 3, a user dons the BTE to the best of their ability. The accelerometer on the BTE portion measures any combination of acceleration due to gravity in one of the x, y, z directions, or any combination thereof. The measured acceleration due to gravity is input in to the pre-trained classifier. The classifier outputs a good/proper fit or a poor/improper fit. In response, the hearing assistance device provides feedback regarding whether the device is properly positioned or improperly positioned.

In an example, and based on the assumption that the user has placed the in-ear transducer 104 in the user's ear, the device 100 provides an acoustic indication regarding the positioning of the BTE portion 102. The transducer may output a first type of audio output to indicate a proper fit and second, different type of audio output to indicate an improper fit. The audio output indications may be words or tones that are associated with a proper positioning and different words or tones that are associated with an improper positioning.

In aspects, a user device in communication with the hearing assistance device 100 assists the hearing assistance device in providing the user with an indication regarding how the hearing assistance device is positioned. In one example, the device 100 transmits information associated with the measured acceleration due to gravity to the user device. An app on the user device determines how the hearing assistance device is positioned around the user's ear. In this example, the app inputs the received information into the pre-built classifier model. The classifier model outputs how the BTE portion is positioned. The user device transmits an indication of the positioning to the hearing assistance device. The hearing assistance device receives this information and outputs an indication in accordance with the determined position.

In aspects, the user device provides the feedback to the user. In one example, the hearing assistance device wirelessly transmits information associated with the measured acceleration to the user device to allow the user device to provide feedback regarding the positioning of the hearing assistance device. In aspects, an app on the user device inputs the received information into the pre-built classifier model. Based on the output of the model, the app visually displays how the BTE portion 102 is positioned around the user's ear. In aspects, the app provides guidance on how to adjust a poorly positioned BTE. In one example, the guidance includes arrows indicating the direction the BTE portion of the device should be moved to achieve a better fit, audio instructions, or a combination of both visual and audio instructions.

In aspects, the acceleration due to gravity is measured as the user adjusts the BTE portion around their ear. The device or user device iteratively provides feedback, based on the measured acceleration, as the hearing assistance device is adjusted. The feedback may be audio feedback provided by the hearing assistance device, or any combination of audio and visual feedback provided by the user device. In this manner, feedback is provided in real-time as the user adjusts the BTE device. The feedback guides or coaches the user to adjust the positioning of the BTE until it is properly positioned.

In an example use case, a user is trying to properly don the hearing assistance device 100. The hearing assistance device is paired with the user's personal smart device (user device). The BTE portion 102 is placed around the user's ear and the accelerometer measures the acceleration due to gravity in one or more of the x, y, and z directions, or any combination thereof. The measured acceleration is transmitted to an app running on the user device. The user device determines if the BTE portion is properly positioned. The application provides audio and/or visual feedback to the user regarding the positioning of the BTE portion around the user's ear.

If the BTE portion is hanging off of the ear as shown in 200B, the app may display an arrow directing the user to push the BTE portion towards the user's skull. If the BTE portion is pushed above the user's ear as shown in 200C, the app may display an arrow directing the user to push the BTE portion down, towards the back of the user's head. In aspects, other visual and/or audio cues guide the user on how to adjust the positioning of the BTE device.

The accelerometer measures the acceleration due to gravity as the position of the hearing assistance device is adjusted around the user's ear. The device 100 transmits the measured acceleration due to gravity to the app. The app provides feedback based on the more-recently measured acceleration. In this manner, as the position of the BTE changes, the acceleration due to gravity changes and iterative feedback is provided to the user via at least one of the device 100 or a user device.

As described herein, the feedback is provided by the hearing assistance device, the user device, or both the hearing assistance device and the user device. Without the user device, the user will receive audio feedback through the hearing assistance device. With the user device, the user may receive feedback from either or both of the hearing assistance device and the user device. In aspects, the app on the user device provides different types of feedback as compared to the audio cues provided by the hearing assistance device. For example, the app may provide visual indications for how to adjust the BTE portion. The feedback provided based on acceleration due to gravity lets the user know if they have correctly donned the device without the help of an audiologist or additional person. Properly positioning the BTE portion of the device is also important for the user's long-term comfort and the stability of the device.

In the preceding, reference is made to aspects presented in this disclosure. However, the scope of the present disclosure is not limited to specific described aspects. Aspects of the present disclosure may take the form of an entirely hardware embodiment, an entirely software embodiment (including firmware, resident software, micro-code, etc.) or an embodiment combining software and hardware aspects that may all generally be referred to herein as a "component," "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium include: an electrical connection having one or more wires, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the current context, a computer readable storage medium may be any tangible medium that can contain or store a program.

The flowchart and diagrams in the Figures illustrate the architecture, functionality and operation of possible implementations of systems, methods and computer program products according to various aspects. In this regard, each block in the flowchart or block diagrams may represent a module, segment or portion of code, which comprises one or more executable instructions for implementing the specified logical function(s). In some implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustrations, and combinations of blocks in the block diagrams and/or flowchart illustrations can be implemented by special-purpose hardware-based systems that perform the specified functions or acts, or combinations of special purpose hardware and computer instructions.

The invention claimed is:

1. A method performed by a behind-the-ear (BTE) hearing assistance device comprising:

measuring acceleration due to gravity using an accelerometer positioned on a BTE portion of the hearing assistance device; and taking one or more actions to provide feedback to a user regarding how the hearing assistance device is positioned around an ear of the user based, at least in part, on the measured acceleration, wherein the feedback comprises a first audio indication when the hearing assistance device is properly positioned around the ear of the user and a second audio indication when the hearing assistance device is not properly positioned around the ear of the user.

2. The method of claim 1, wherein the feedback is provided by an audio output transducer of the hearing assistance device.

3. The method of claim 1, wherein taking the one or more actions comprises:

transmitting information associated with the measured acceleration to a user device in wireless communication with the hearing assistance device; and receiving, from the user device, information regarding how the hearing assistance device is positioned around the ear of the user;

wherein the feedback is further based on the received information.

4. The method of claim 1, wherein taking the one or more actions further comprises:

transmitting information associated with the measured acceleration to a user device in wireless communication with the hearing assistance device to assist in providing the feedback.

5. The method of claim 1, wherein the measuring comprises measuring acceleration due to gravity in one of an x, y, z direction, or any combination thereof.

6. The method of claim 5, wherein the measured acceleration due to gravity is input into a pre-trained classifier that outputs that the hearing assistance device is one: of properly positioned around the ear of the user or not properly positioned around the ear of the user.

7. A method: performed by a behind-the-ear (BTE) hearing assistance device comprising:

measuring acceleration due to gravity using an accelerometer positioned on a BTE portion of the hearing assistance device as a position of the hearing assistance device is adjusted around an ear of a user; and taking one or more actions to iteratively provide feedback to the user regarding how the hearing assistance device is positioned around the ear of the user based, at least in part, on the measured acceleration as the hearing assistance device is adjusted around the ear of the user.

8. A behind-the-ear (BTE) hearing assistance device comprising:

at least one processor; and memory coupled to the at least one processor, the memory including instructions executable by the at least one processor to cause the hearing assistance device to:

measure acceleration due to gravity using an accelerometer positioned on a BTE portion of the hearing assistance device; and take one or more actions to provide feedback to a user regarding how the hearing assistance device is positioned around an ear of the user based, at least in part, on the measured acceleration, wherein the feedback comprises outputting a first audio indication when the hearing assistance device is properly positioned around the ear of the user and outputting a second audio indication when the hearing assistance device is not properly positioned around the ear of the user.

9. The hearing assistance device of claim 8, wherein the instructions cause the hearing assistance device to provide the feedback by instructing an audio output transducer of the hearing assistance device to output the feedback.

10. The hearing assistance device of claim 8, wherein the instructions cause the hearing assistance device to take the one or more actions by:

transmitting information associated with the measured acceleration to a user device in wireless communication with the hearing assistance device;

receiving, from the user device, information regarding how the hearing assistance device is positioned around the ear of the user; and outputting, by an audio output transducer of the hearing assistance device, an audio indication of how the hearing assistance device is positioned based on the received information.

11. The hearing assistance device of claim 8, wherein the instructions cause the hearing assistance device to take the one or more actions by:

transmitting information associated with the measured acceleration to a user device in wireless communication with the hearing assistance device to assist in providing the feedback.

12. The hearing assistance device of claim 8, wherein the instructions cause the hearing assistance device to measure the acceleration by measuring the acceleration due to gravity in one of an x, y, z direction, or any combination thereof.

13. The hearing assistance device of claim 12, wherein the instructions further cause the hearing assistance device to input the measured acceleration due to gravity into a pre-trained classifier that outputs that the hearing assistance device is one: of properly positioned around the ear of the user or not properly positioned around the ear of the user.

14. A behind-the-ear (BTE) hearing assistance device comprising:

at least one processor; and memory coupled to the at least one processor, the memory including instructions executable by the at least one processor to cause the hearing assistance device to:

measure acceleration due to gravity using an accelerometer positioned on a BTE portion of the hearing assistance device as a position of the hearing assistance device is adjusted around an ear of a user; and take one or more actions to iteratively provide feedback to the user regarding how the hearing assistance device is positioned around the ear of the user based, at least in part, on the measured acceleration as the hearing assistance device is adjusted around the ear of the user.

15. An audio system, comprising:

a behind-the-ear (BTE) hearing assistance device in communication with an application running on a wireless user device;

the hearing assistance device comprising: a BTE portion coupled to an audio output transducer, and an accelerometer, at least one microphone, a processor, a memory, and a wireless communication unit, each in the BTE portion of the hearing assistance device, the memory including instructions executable by the processor to cause the hearing assistance device to:

measure acceleration due to gravity using the accelerometer when the hearing assistance device is positioned around an ear of a user; and transmit the measured acceleration to the application; and wherein the application provides feedback to the user regarding how the hearing assistance device is positioned around the ear of the user based, at least in part, on the measured acceleration, wherein the feedback provided by the application coaches the user on how to adjust positioning of the hearing assistance device.

16. The audio system of claim 15, wherein:

the instructions further cause the hearing assistance device to:

measure the acceleration using the accelerometer as the hearing assistance device is adjusted around the ear of the user; and transmit, to the application, the measured acceleration as the hearing assistance device is adjusted around the ear of the user; and the application provides the feedback by iteratively providing the feedback calculated based on the measured acceleration as the hearing assistance device is adjusted around the ear of the user.

17. The audio system of claim 15, wherein:

the instructions cause the hearing assistance device to measure the acceleration due to gravity by measuring the acceleration in one of an x, y, z direction, or any combination thereof; and the application inputs the measured acceleration into a pre-trained classifier that outputs, via the application, that the hearing assistance device is one: of properly positioned around the ear of the user or not properly positioned around the ear of the user.

* * * * *